US008006631B2

(12) United States Patent
Arustamov et al.

(10) Patent No.: US 8,006,631 B2
(45) Date of Patent: Aug. 30, 2011

(54) RADIOACTIVE WASTE REPROCESSING METHOD AND DEVICE

(75) Inventors: Arthur Eduardovich Arustamov, Sergiev Posad (RU); Demetrius Rudolfovich Vasendin, Sergiev Posad (RU); Valeriy Alekseevich Gorbunov, Sergievo-Posadsky raion (RU); Sergey Aleksandrovich Dmitriev, Moscow (RU); Fyodor Anatolevich Lifanov, Sergiev Posad (RU); Alexander Pavlovich Kobelev, Sergievo-Posadsky raion (RU); Mikhail Anatolevich Polkanov, Sergiev Posad (RU)

(73) Assignees: Joint Stock Company "Alliance-Gamma", Moscow (RU); State Unitary Enterprise Moscow Scientific & Industrial Assn., Mosynpo Rabon (RU)

( * ) Notice: Subject to any disclaimer, the term of this patent is extended or adjusted under 35 U.S.C. 154(b) by 450 days.

(21) Appl. No.: 12/094,183

(22) PCT Filed: Nov. 13, 2006

(86) PCT No.: PCT/RU2006/000593

§ 371 (c)(1),
(2), (4) Date: May 19, 2008

(87) PCT Pub. No.: WO2007/058567

PCT Pub. Date: May 24, 2007

(65) Prior Publication Data

US 2008/0257235 A1 Oct. 23, 2008

(30) Foreign Application Priority Data

Nov. 18, 2005 (RU) ..... 2005135826

(51) Int. Cl.

| | |
|---|---|
| ***G21F 9/00*** | (2006.01) |
| ***F23G 7/00*** | (2006.01) |
| ***F23G 5/10*** | (2006.01) |
| ***F23J 15/00*** | (2006.01) |
| ***F23J 3/00*** | (2006.01) |

(52) U.S. Cl. ..... 110/237; 110/250; 110/341; 110/215; 110/216

(58) Field of Classification Search ..... 110/237, 110/229, 230, 231, 210, 211, 212, 213, 214
See application file for complete search history.

(56) References Cited

U.S. PATENT DOCUMENTS 5,634,414 A * 6/1997 Camacho ..... 110/346

(Continued)

FOREIGN PATENT DOCUMENTS

JP 2002263475 9/2002

(Continued)

OTHER PUBLICATIONS

International Search Report for PCT/RU2006/000593.

*Primary Examiner* — Kenneth B Rinehart
*Assistant Examiner* — David J Laux
(74) *Attorney, Agent, or Firm* — Caesar, Rivise, Bernstein, Cohen & Pokotilow, Ltd.

(57) ABSTRACT

Radioactive waste treatment method, includes: (a) loading waste into plasma shaft furnace by conveying waste by hermetic conveyor from automated storage into plasma shaft furnace, wherein conveying is loading is controlled; (b) pyrolizing waste; (c) oxidizing coke; (d) withdrawing pyrogas and slug from furnace; (e) afterburning pyrogas in combustion chamber at an afterburning temperature of 1200-1350° C.; (f) supplying air into combustion chamber at two levels during afterburning step: (1) prechamber pyrogas air supply level, and (2) an upper part of combustion chamber air supply level; and (g) quenching an off-gas to 200-250° C. with subsequent mechanical cleaning and absorption cleaning and further cooling. A radioactive waste treatment plant is also disclosed.

10 Claims, 2 Drawing Sheets

U.S. PATENT DOCUMENTS

| | | | | |
|---|---|---|---|---|
| 5,787,823 | A * | 8/1998 | Knowles | 110/344 |
| 6,250,236 | B1 * | 6/2001 | Feizollahi | 110/346 |
| 6,502,520 | B1 * | 1/2003 | Nishi et al. | 110/237 |
| 6,820,564 | B2 * | 11/2004 | Gnedenko et al. | 110/187 |
| 7,793,601 | B2 * | 9/2010 | Davison et al. | 110/229 |

FOREIGN PATENT DOCUMENTS

| | | |
|---|---|---|
| JP | 2003019434 | 1/2003 |
| RU | 2107347 C1 | 3/1998 |

* cited by examiner

RADIOACTIVE WASTE REPROCESSING METHOD AND DEVICE

BACKGROUND OF THE INVENTION

The invention pertains to the field of environmental safety, and more precisely, to the field of radioactive waste treatment of low and intermediate levels containing both combustible components and up to 50% of noncombustible components.

There is a known waste treatment method consisting of solid radioactive waste (SRW) successive transportation in the furnace through the off gas backflow. Waste goes through baking, pyrolysis, incinerating, slag forming, slag and non-combustible SRW melting zones. Further it goes to joint or separate discharging, and cooling to the solid final product for a long-term storage (SU 1810912, 13.08.1990).

Disadvantages of this method are: low speed because of long time of pyrolysis, incinerating, and slag forming and discharging. Also it has a high environmental danger because of intensive radionuclide transfer to gas phase appears under high temperature conditions.

The plasma shaft furnace for radioactive waste treatment is well known. It consists of the restricting bottom-up shaft, equipped by loading unit and off gas pipe in the upper part, and oxidizer (air) supply unit and plasma generators in the bottom part. Also the shafts' bottom part is connected with a horizontal homogenizing chamber, which has in its upper part the vertical plasma reactor (SU 1810912, 13.08.1990).

Disadvantages of this equipment are: the unreliability because of possibility of gas flue blocking by parts of SRW resulting from the short distance from the loading unit, and off-gas speed increasing over the upper part restricting. Also it has the design complexity of a slag discharging unit.

There is known equipment for low and intermediate level radioactive waste treatment which consists of a furnace with a shaft equipped by loading unit and off-gas pipe in the upper part, an oxidizer supply unit in the middle part, and plasma generators in the bottom part. Also the shafts' bottom part is connected with a horizontal homogenizing chamber, which has in its upper part the vertical plasma reactor. There is a melted slag discharging unit in the chambers' bottom part. This unit is a water cooling crystallizer. This equipment also has an off-gas afterburning chamber connected with afterburning product cooling system (cooling heat exchanger) and filter (SU 1810391, 13.08.1990).

A disadvantage of this equipment is unreliability because the melted slag discharging unit design is a poor choice. It has a water cooling crystallizer, and it can be a reason for the low discharging process and final product splitting.

The most similar method to the proposed invention for a technical essence is a method and plant for the treatment of radioactive and toxic waste containing cellulose, polymers, rubber, PVC and non-combustible dirt like a glass and metal, with subsequent incinerating product melting until a solid final product is obtained (RU 2107347, 1998). This method consists in the following.

The waste packaged into the polypropylene containers goes to the plasma shaft furnace heated up to 1400° C. through the loading unit until the shaft is filled. Then the oxidizer (blast air) goes to the shaft through the top and down air supply units. The waste level in the shaft is constant. At the same time, the fuel jet turns on and compressed air goes to the center of shaft. There is a waste burning in the furnace. By gravity, the coke and inorganic part of waste goes to the burning and melting zone located in the homogenizing chamber. The obtained melt exits the furnace through the lower or upper drain hole if needed. The melt flows down through the vertical drain channels into containers. The produced pyrogas exits through the sloped off-gas channel and comes to the afterburning chamber. There is an afterburning of combustible components under the temperature 1000° C., and then gases come to the water cooling system (water evaporator) for cooling from 1000° C. to 300° C. Water is supplied by pneumatic jets. Afterwards, cooled gas goes to the bag filter and then to the heat exchanger for cooling to 250-280° C., and further it goes to the scrubber for acid gas absorption.

Disadvantages of this method are:

- the loading system low productivity provided by back-and-forth waste supply system design, and low hermiticity of loading unit;
- high amount of fume gases because of fuel burners use and waste burning in the intensive oxidizer supply conditions in the shaft;
- the impossibility of liquid radioactive waste treatment by this method;
- insufficient degree of off-gas cleaning from radionuclide and aerosols;
- the low chemical stability of taken slug in result of free carbon high content in the slug and low homogenization;
- plant work unreliability because:
  - the gas collecting system design can be a reason of gas flue blocking by SRW parts, and hence, pressure increasing in the furnace;
  - full shaft height is not used, and there is a radionuclides carry-over possibility;
  - polypropylene containers use, that can be a reason of the waste moving stoppage in the shaft in result of melting and hanging of polymer package;
  - low maintainability of the most high-heat elements.

The task of the original invention is the elimination of defects described above, with a high safety degree ensuring the provision of a liquid combustible radioactive waste treatment, and an increasing economic effect of radioactive waste treatment.

SUMMARY OF THE INVENTION

This task accomplishment is described below. The radioactive waste treatment method includes the waste packages supply into the shaft furnace, waste pyrolysis with coke oxidation, melted slug discharging and pyrogas withdrawal out of the furnace, pyrogas afterburning in the afterburner, off-gas quenching with following mechanical and absorption cleaning, where a packages supply into the plasma furnace goes from automatic storage and through the hermetic conveyor providing the loading process adjustment, the pyrogas afterburning goes by temperature of 1200-1350° C. during two levels air supply into combustion chamber providing air supply at the pyrogas supply level into the prechamber and air supply into the upper part of combustion chamber, the off-gas quenching goes until the temperature of 200-250° C., after absorption the off-gas goes to additional cooling and cleaning from moisture and aerosols.

It's preferable that the prechamber air supply is 50-80% of total air consumption which is needed for full pyrogas combustion, and upper part shaft air supply is 50-20% vol.

It's preferable that off-gas mechanical cleaning goes at bag-filters with periodical compressed air regeneration without the filter shut-down, and the after regeneration dust is collecting and going back for the treatment into the shaft furnace.

This task has also decision by using of radioactive waste treatment plant which consists of waste loading unit, shaft plasma furnace with melter in the bottom part and slug discharging unit connected with slug receiving unit, air supply unit, gas flue, pyrogas combustion chamber, evaporator-heat exchanger for a quick off-gas temperature decreasing, gas cleaning system equipped by bag-filter, scrubber and heat exchanger, also this plant consists of pumps and tanks for reagents and final products, the loading unit consists of loading bin connected with automatic waste packages storage by hermetic conveyor and equipped at least by one waste presence sensor, also the loading bin is equipped at least by two hermetic sliding shutters, heat shield and loading pipe, the furnace shaft upper part is equipped by centrifugal burners for emergency irrigation, the combustion chamber contains a prechamber and equipped by plasmatron placed in the prechamber cover, and by two air supply devices, one of them placed at the pyrogas supply level in the prechamber, another one placed in the upper part of combustion chamber, the off-gas cleaning system is additionally equipped by filter-separator and fine filter.

It's preferable that the furnace and combustion chamber contain the gas flue piping equipped by emergency gas off valves and emergency absorption cleaning system.

Slug discharging unit in proposed plant contains drain device with central hole and stopper.

It's preferable that furnace contains two plasma generators which can change the capacity from 80 to 170 kW.

The device of air supply into shaft furnace is placed in the bottom part of shaft.

The split shaft performance with smelter placed at the cart is recommended. The connection of slug discharging unit and melted slug receiving unit is made also split.

Additionally, the furnace loading unit is equipped by jet for liquid radioactive waste supply.

The method and plant characters described above, allows deciding the main tasks and removing disadvantages of prototype's technical decision.

High safety of proposed decision provide as follows.

Solid radioactive wastes packaged into the craft bags goes to the automatic storage consisting on two automatic lines with two lines of shelves and stacker in each line. Wastes are placed at the automatic storage shelves in individual package or cassette. During of the treatment process, waste packages goes from automatic storage to loading unit by operating complex. The waste loading adjusts by waste presence sensors placed in the loading unit and in upper part of shaft, below the loading pipe. The sensors placed in different devices of loading unit and driving mechanisms, are connected in local schemes providing both automatic and manual modes of waste loading. It minimizes the contact of personnel with radioactive waste.

The process safety end efficiency depending on a smoke fumes volume reduction because only fuel-less plasma generators are used and there is no additional oxidizer and fuel supply. Also there is an emergency explosive gas outgoing line from the furnace and combustion chamber through gas-collecting system equipped by emergency gas off valves.

Moreover, additional gas cleaning system with filter-separator and fine filters minimizes the atmospheric injection of harmful impurities.

The efficiency is also dependent on creation of vitiated pyrogas with sufficient amounts of combustible inorganic ($CO$, $H_2$, soot) and organic substances (gaseous carbohydrates, their oxygen derivative substances).

The air supply into the combustion chamber by two proposed methods provides full pyrogas combustion. There is no expediency to keep the temperature below 1200° C. and more than 1350° C. in combustion chamber because of full pyrogas combustion will be in this range.

The invention provides both combustible and noncombustible solid radioactive waste, and also there is a possibility of combustible liquid radioactive waste supply into the upper shaft part through the jet. It extends the treated waste kinds.

The loading unit design of the proposed method provides the heat protection, hermiticity and work reliability of the plant.

BRIEF DESCRIPTION OF SEVERAL VIEWS OF THE DRAWINGS

The proposed method and plant for low and intermediate level radioactive waste treatment are shown in the following drawing FIGS. 1 and 2.

Figure 1:
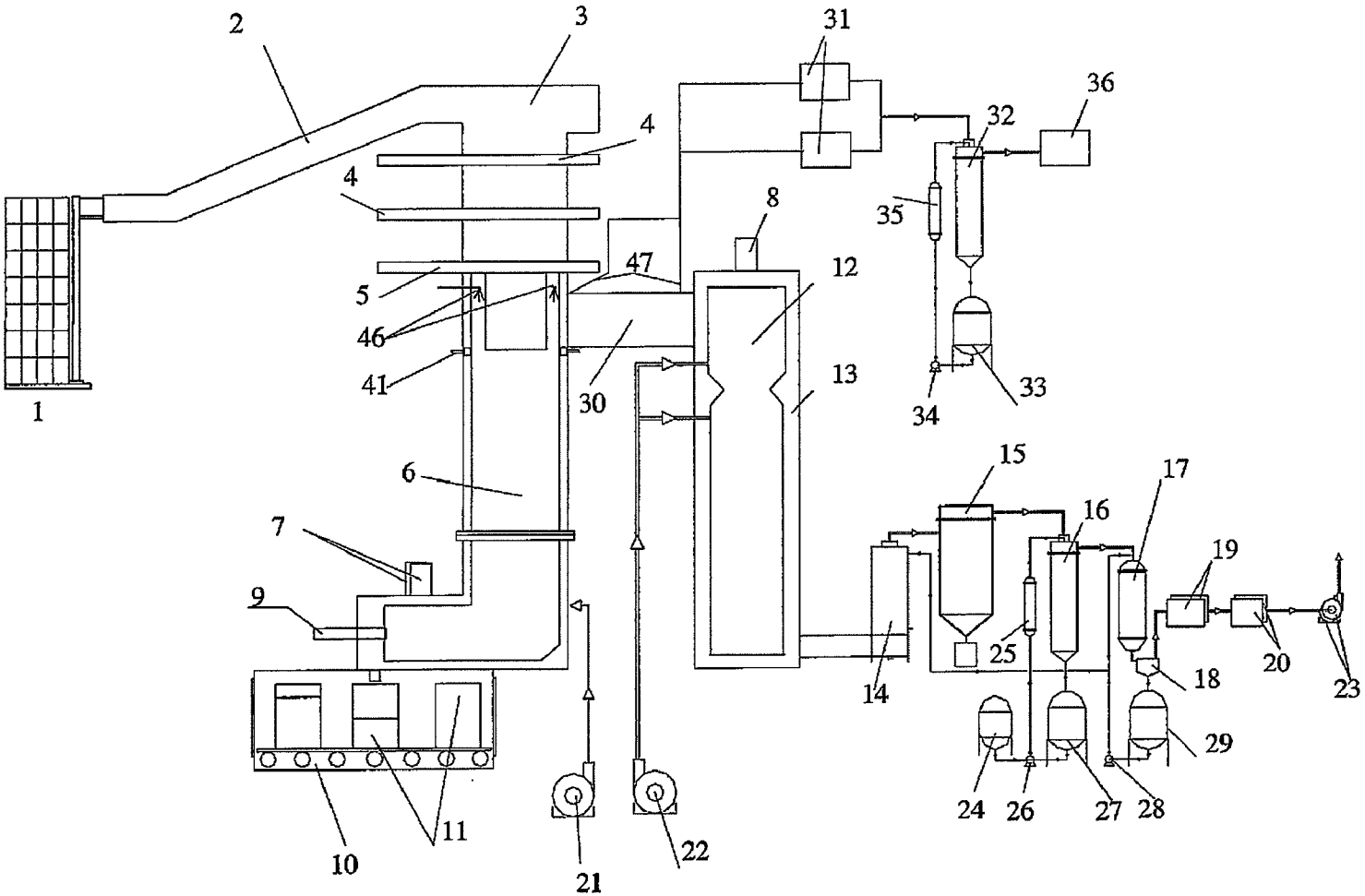
FIG. 1—the technological scheme of proposed method.

At the FIG. 1 are presented: 1—automatic waste storage, 2—conveyor, 3—loading tray, 4—sliding shutter, 5—heat shield, 6—plasma shaft furnace, 7—the direct current furnace plasma generators, 8—pyrogas combustion chamber plasma generator, 9—slug discharge unit, 10—melted slug receiving unit, 11—receiving containers, 12—pyrogas prechamber, 13—pyrogas combustion chamber, 14—evaporating heat exchanger, 15—bag filter, 16—scrubber, 17—shell-and-tube heat exchanger, 18—gas separator, 19—gas mixer, 20—fine filter, 21—furnace fan, 22—pyrogas combustion chamber fan, 23—vacuum fan, 24—alkali dosing tank, 25—ytat exchanger, 26,28—pumps, 27—circulating water tank, 29—condensate collector, 30—gas flue (between furnace and combustion chamber), 31—explosive valves, 32—absorber, 33—circulating water tank, 34—pump, 35—heat exchanger, 36—filter, 46—emergency irrigation jets, 47—explosive gas emergency gas flue.

Figure 2:
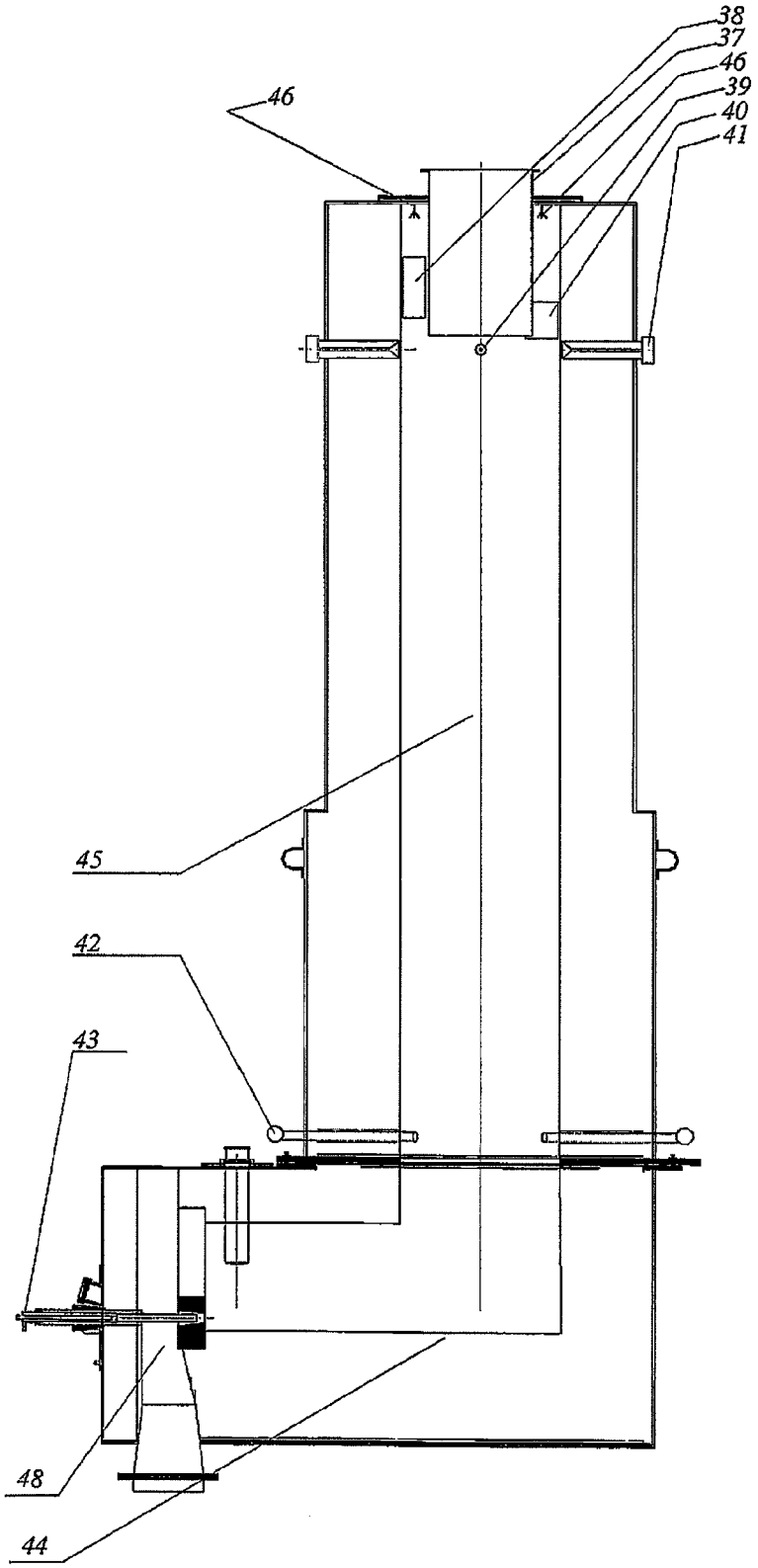
FIG. 2—the plasma shaft furnace section view.

At the FIG. 2 are presented:

37—loading pipe, 38—pyrogas outgoing line, 39—LRW supply jet, 40—explosive valves canal, 41—waste presence sensor, 42—air supply unit, 43—stopper unit, 44—smelter, 45—shaft, 48—discharging canal.

DETAILED DESCRIPTION OF PREFERRED EMBODIMENTS

The sample of method realization at the proposed plant is described below.

Solid radioactive waste packaged in craft bags and placed in containers or cassettes goes by special auto transport from sorting and preparing area to receiving and check-in control area. There is unloading, characterization (information about morphology, radionuclide content specific activity, mass, dose rate), dosimetry control. Then, waste goes to automatic storage 1 consisting of two automatic lines with two lines of shelves and stacker in each. Wastes are placing at the shelves of automatic storage 1 into individual packages or cassettes in amount of day treatment consumption. The packages (cassettes) with specific activity of $3.7\times10^6$ Bk/liter go from automatic storage 1 to the conveyor 2 by operating complex and stacker, and then it goes to loading tray 3. The unit hermiticity is provided by sliding shutters system 4. The waste placed into the loading tray 3 by conveyor 2 through the sliding shutters system 4, heat shield 5 and loading pipe 37, goes to plasma shaft furnace 6.

The waste loading into the plasma shaft furnace 6, is adjusting by the system of waste presence sensors placed in the loading unit and upper shaft part under loading pipe 37.

There all stages of radioactive waste conversion (drying, pyrolisys, coke oxidation, and slug melting) with pyrogas and melted slug getting are going on in the plasma furnace shaft 6.

Melted slug is collecting in the smelter 44. The smelter heating is provided by two plasma generators 7 with variable electric capacity in the range 80-170 kW, where the plasma creating gas is compressed air. The slug discharging unit 9 placed in the smelter end wall 44, consists of drain unit with central hole and stopper 43 fastened in the water cooled holder, and water cooled stopper shield with discharging process control means. While the stopper is coming out of discharging unit canal, melted slug is discharging out of the smelter 44. The slug receiving hermetic box 10 is placed under the smelter 44, where melted slug receiving, keeping and cooling in metallic container 11 are going on. The container 11 filled up by slug, is taken out of the box, loading into the irreparable safety container which goes through characterization and marking, and then goes to the solid waste storage.

At the same time, the additional hydrocarbon liquid radioactive waste (specific activity is $1\times10^4$ Bk/liter) goes to the upper part of shaft through the jet and burns out with solid waste packages.

The pyrogas generated with the temperature +250-300° C. in the plasma furnace 7, goes to the upper part (prechamber) of pyrogas combustion chamber 13, by lined gas flue. The gas collecting system 47 goes out of plasma furnace 6 and pyrogas combustion chamber 13. There placed across the explosive valves 31 used for emergency pyrogas overshoot if the pressure in the gas flue is more than 5 kPa. The emergency overshoot cleaning system is installed after explosive valves. It consists of absorber 32 and filter system 36. The constant circulation of alkali solution is going on in the absorber for gas cooling and acid components neutralization.

The heating source in the prechamber is the plasma generator 8 placed in the center of pyrogas combustion chamber cover, similarly to the one used in the furnace smelter. The plasma generator 8 of the pyrogas combustion chamber 13, after waste loading, is also used for stable pyrogas combustion keeping. Further, the pyrogas combustion goes on in auto thermal mode if the caloric value is enough.

The blast air goes to the prechamber by three tangential streams at the same level of pyrogas entry, in amount 60% of total air volume which is needed for a full pyrogas combustion, another 40% of air volume tangentially goes to the upper part of pyrogas combustion chamber across the throat in the apparatus profile. The blast air is going by blower fan 22. The remote operated chokes with electric drive are installed at the airways. The gas temperature in the pyrogas combustion chamber is about 1250° C. The high temperature in comparison with prototype allows making the conversion of non-combusted particles more complete. These particles are generated as a result of hydrocarbon combustion in the shaft furnace. Smoke fumes having combustion chamber temperature go to the bottom part of evaporating heat exchanger 14 from combustion chamber 13 through lined gas flue. The evaporating heat exchanger is a hollow lined cylindrical apparatus where a gas quenching to temperature of +200° C. is going on. It is provided by evaporation of pneumatic jet sprayed flushing solution mixed with air. Three jets are installed in the upper part of evaporating heat exchanger. The flushing solution volume is automatically adjusted by electric drive gates, depending on the smoke fumes temperature after evaporating heat exchanger. The gas quenching from 1250 to 200° C. allows the prevention of dioxin formation. After evaporating heat exchanger 14, off-gas goes to the parallel bag filters 15, where a main amount of solid aerosol particles (dust) is catching. One filter is main working apparatus, another one is reserved. The filters work in non-stop mode: there is air blowback regeneration then the pressure more than 1.5–2 kPa. Then the regeneration is not enough or residue activity is high, the filter is changing. The dust after regeneration is collecting in the bag filter bin. Then waste treatment is finished, the dust goes to the containers by screw device, and than it goes to the shaft furnace for a treatment.

The off-gas cleaned at the bag filter 15, goes to the scrubber 16, where intensive alkali solution irrigation of gas flow is going on. The irrigation is provided by centrifugal spray jet. The inertial entrainment separator—liquid trap is installed in the scrubber middle part along off-gas upstream. There is off-gas cooling to +50-55° C. and additional cleaning from acid gases and aerosols in the scrubber. After scrubber 16, off-gas goes to the tube are shell cooler 17 for cooling. The cooling water goes to the tube space. The aftertreatment of cooled to 25-35° C. off-gas is going on in the gas-separator 18.

After hot air heating in the gas-mixer 19, off-gas goes to cleaning from aerosol at the fine filter 20 equipped by ultrafine glass fiber, and than it goes to discharging by vacuum fan 23.

In result of carried out tests, it was determined as follows:

The loading system capacity was increased up to 250 kg/hour due to the using of automatic storage, conveyor system, sliding shutter system and waste presence sensors.

In proposed method, the fume smokes amount was decreased 1.5-2 times in comparison with a prototype.

The proposed method allows also treating combustible liquid radioactive wastes without technological mode breach risk.

The off-gas cleaning degree from radionuclides and harmful impurities, was sufficiently increased in comparison with prototype. It was due to the temperature increase of 200-350° C., more effective cooling in the evaporating heat exchanger (to 200-250° C.), and also fine filter use.

The proposed method provides excellent final product quality because there is no free carbon and pieces of metal in the slug.

Moreover, the plant simplicity was achieved by use of two plasma generators, absence of additional lines for oxidizer supply into the shaft, one slug discharging unit presence, and also owing to fuel jets not being used.

In the treatment process there were no cases of gas flue blocking by SRW parts.

The plant safety and reliability were raised.

The invention claimed is:

1. A radioactive waste treatment method, comprising the steps of:

loading waste into a plasma shaft furnace by conveying the waste by a hermetic conveyor from automated storage into the plasma shaft furnace, wherein the conveyor loading is controlled;

pyrolizing the waste;

oxidizing coke;

withdrawing pyrogas and a slug from the furnace;

afterburning the pyrogas in a combustion chamber at an afterburning temperature of 1200-1350° C. by directing said pyrogas in a downstream direction through said combustion chamber;

supplying air into the combustion chamber at two levels during the afterburning step: (1) a prechamber pyrogas air supply level, and (2) an upper part of the combustion chamber air supply level, said prechamber being upstream of the upper part of the combustion chamber; and quenching an off-gas to 200-250° C. for preventing dioxin formation; and directing quenched off-gas through a mechanical filter for removing particulate material from said quenched off-gas;

directing off-gas from said mechanical filter through a scrubber for further cleaning and cooling; and directing off-gas from the scrubber through a heat exchanger for further cooling.

2. The method of claim 1, wherein the prechamber pyrogas air supply level is 50-80% of a total air volume needed for full pyrogas combustion, and the upper part of the combustion chamber air supply level is 50-20% of the total air volume needed for full pyrogas combustion.

3. The method of claim 1, wherein the off-gas mechanical cleaning is conducted at bag filters with periodic air blow back regeneration without filter shutdown, and then the dust goes back for a treatment.

4. A radioactive waste treatment plant, comprising:

a waste loading unit for directing waste into an upper end of a shaft of a plasma shaft furnace, said waste loading unit being connected with an automated waste storage system by a hermetic conveyor, wherein the waste loading unit comprises a heat shield, a loading pipe, and a loading tray equipped with at least two sliding shutters, said loading pipe including an opening adjacent said upper end of the shaft of the plasma shaft furnace through which waste is introduced into said plasma shaft furnace;

at least one waste presence sensor adjacent said opening in the loading pipe for aiding in controlling the loading of waste into said plasma shaft furnace;

said plasma shaft furnace comprising two centrifugal jets for emergency irrigation, a smelter in a bottom furnace part and a slug discharging unit connected with a melted slug receiving unit;

an air supply unit communicating with the shaft of the plasma shaft furnace;

a gas flue communicating with an upper end of said shaft of the plasma shaft furnace and a pyrogas combustion chamber;

said pyrogas combustion chamber comprising a prechamber, a prechamber cover, a plasmatron installed in the prechamber cover, a pyrogas supply level air supply device installed at a pyrogas supply level in the prechamber, and an upper combustion chamber air supply device installed in an upper part of the combustion chamber;

an evaporating heat exchanger communicating with said pyrogas combustion chamber through a gas flue for gas quenching gas received from said combustion chamber through said gas flue;

a gas cleaning system communicating with said evaporating heat exchanger comprising a bag filter, a filter-separator and a fine filter;

a scrubber communicating with the bag filter for receiving and scrubbing off-gas received from said bag filter; and a heat exchanger unit communicating with said scrubber for receiving gas from said scrubber and further cooling said gas from said scrubber.

5. The plant of claim 4, wherein the plasma shaft furnace and the pyrogas combustion chamber have a gas collecting system equipped with emergency gas overshoot valves and an emergency absorption cleaning system.

6. The plant of claim 4, wherein the slug discharging unit comprises a drain device with a central hole and a stopper.

7. The plant of claim 6, wherein the plasma shaft furnace contains two plasma generators adapted to generate plasma in a range from 80 to 170 kW.

8. The plant of claim 4, wherein the air supply unit is placed in a bottom part of the plasma shaft furnace.

9. The plant of claim 4, wherein the plasma furnace shaft is divided, the smelter is placed at a cart, and connection between the slug discharging unit and a melted slug receiving box is also divided.

10. The plant of claim 4, wherein the waste loading unit further comprises a jet of liquid combustible radioactive waste supply in the furnace.

* * * * *